United States Patent [19]

Dunn

[11] Patent Number: 4,937,494

[45] Date of Patent: Jun. 26, 1990

[54] HIGH PRESSURE DISCHARGE LAMP HAVING AN ELECTRODE LEAD-THROUGH WITH A POSITIONING CRIMP

[75] Inventor: John P. Dunn, Bath, N.Y.

[73] Assignee: North American Philips Corporation, New York, N.Y.

[21] Appl. No.: 846,166

[22] Filed: Mar. 31, 1986

[51] Int. Cl.[5] ..... H01J 61/22

[52] U.S. Cl. ..... 313/623

[58] Field of Search ..... 313/621, 623, 624, 625, 313/631

[56] References Cited

U.S. PATENT DOCUMENTS 4,065,691 12/1977 McVey ..... 313/625 X 4,075,530 2/1978 Furukubo et al. ..... 313/625

*Primary Examiner*—Sandra O'Shea

*Attorney, Agent, or Firm*—Brian J. Wieghaus

[57] ABSTRACT

A high pressure discharge lamp has a discharge vessel with a closure and an electrode lead-through with an electrode rod mounted thereon. The closure has an aperture therethrough with a predetermined diameter. The lead-through comprises an elongated cylindrical member dimensioned to fit closely within the aperture through the closure, and a limiting means for limiting the distance the lead-through extends in the discharge envelope. The lead-through is crimped at a predetermined location on its outer surface, forming the limiting means including a plurality of alternating contractions and expansions. The expansions form protuberances having a diameter greater than the predetermined inner diameter of the aperture. The protuberances limit the extent of insertion of the lead-through into the discharge envelope, align the lead-through on the closure with a centerline attitude, and determine the distance the electrode rod is inserted within the discharge vessel.

4 Claims, 2 Drawing Sheets

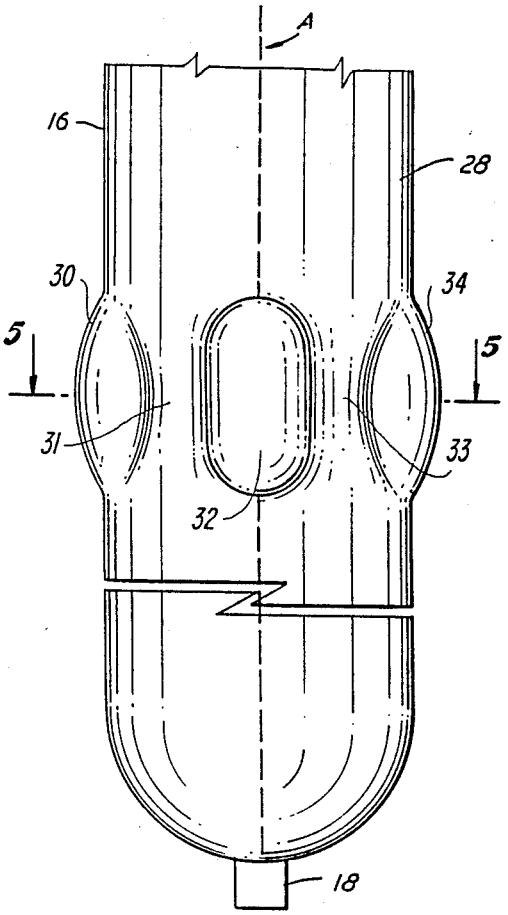
FIG. 4
FIG. 5
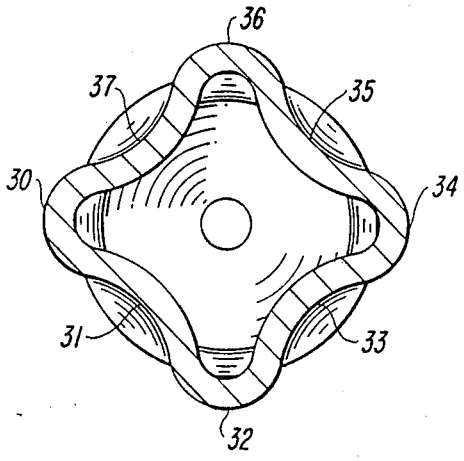

HIGH PRESSURE DISCHARGE LAMP HAVING AN ELECTRODE LEAD-THROUGH WITH A POSITIONING CRIMP

BACKGROUND OF THE INVENTION

This invention relates to high pressure discharge lamps.

High pressure discharge lamps include a discharge vessel having a closure with an aperture therethrough, an electrode lead-through extending through the aperture, and an electrode rod mounted on the lead-through and inserted within the discharge vessel.

During at least one commercially viable manufacturing process for a discharge lamp, the lead-through is scraped at a location on its outer surface. Ideally, the lead-through is evenly scraped, then inserted into the aperture until its scrape contacts the closure, so it is mounted perpendicularly at a predetermined height in the discharge vessel. The scrape on the lead-through limits the extent of insertion of the lead-through into the discharge vessel, and determines the distance its electrode rod is inserted within the discharge vessel.

High pressure discharge lamps manufactured in this fashion can have the scrape on the lead-through be made irregular or uneven. Because the uneven scrape on the lead-through will unevenly contact the closure, the lead-through will not mount perpendicularly on the closure with a centerline attitude, but instead mount at an angle. Or alternatively, it will not mount at all and instead push through and fall into the discharge vessel. Consequently, the uneven scrape on the lead-through can cause the discharge lamp to have a substantially shorter lamp life or defective lamp operating characteristics.

In another high pressure discharge lamp of this type, an electrode rod is supported by a tubular in-lead. The tubular in-lead has a bidirectional crimp functioning only to retain or lock the electrode rod within the tubular in-lead.

SUMMARY OF THE INVENTION

It is an object of this invention to provide an improved high pressure discharge lamp.

It is a feature of this invention that the electrode lead-through is crimped at a predetermined location on its outer surface.

It is an advantage of this invention that the electrode lead-through mounts uniformly onto the discharge vessel.

In accordance with the invention there is provided a high pressure discharge lamp comprising a discharge vessel with a closure, an electrode lead-through, and an electrode rod mounted on the lead-through. The closure has an aperture therethrough with a predetermined diameter. The lead-through includes an elongated cylindrical member dimensioned to fit closely within the aperture through the closure, and a limiting means for limiting the distance the lead-through extends into the discharge vessel. The lead-through is crimped at a predetermined location on its outer surface forming the limiting means including a plurality of alternating contractions and expansions. The expansions form protuberances. At the protuberances the lead-through has a diameter greater than the predetermined diameter of the aperture of the closure. The protuberances limit the extent of insertion of the lead-through into the discharge vessel, align the lead-through on the closure with a centerline attitude, and determine the distance the electrode rod is inserted within the discharge vessel.

Other objects, features and advantages will become apparent to those skilled in the art from the following description and appended claims when considered in conjunction with the accompanying drawing.

BRIEF DESCRIPTION OF THE DRAWINGS

FIG. 4 is a front view of an electrode lead-through crimped at a predetermined location, on its outer surface.

FIG. 5 is a cross-sectional view of the crimped electrode lead-through in FIG. 4 taken on the line 5—5'.

DESCRIPTION OF THE PREFERRED EMBODIMENTS

Figure 1:
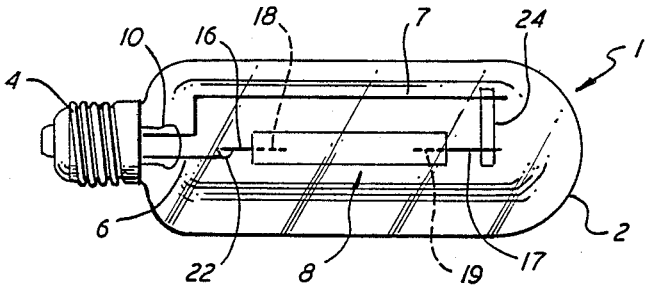
FIG. 1 is a view of one embodiment of a high pressure discharge lamp.

In the various figures of the drawing corresponding parts are identified with the same reference characters. The drawing is schematic only and not to scale.

Referring to FIG. 1 of the drawing, there is shown high pressure discharge lamp 1 having glass envelope 2, base 4, rigid conductive wires 6 and 7, and discharge vessel 8. Envelope 2 has sealed-end portion 10 which is secured within base 4. Wires 6 and 7 are disposed within envelope 2. Wires 6 and 7 pass through sealed-end portion 10 for connection to base contacts (not shown) on base 4. Discharge vessel 8 is disposed within envelope 2 and is electrically coupled across wires 6 and 7. Lead-through 16 is electrically coupled through flexible conductor 22 to wire 6, and lead-through 17 is electrically coupled through an auxiliary conductor 24 to wire 7.

Figure 2:
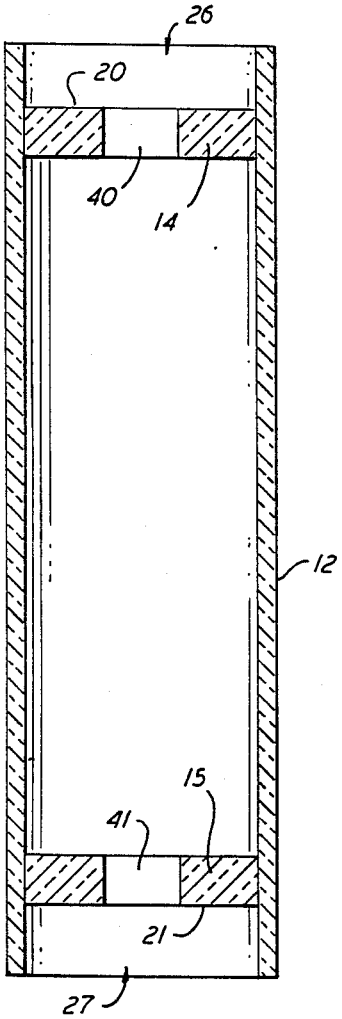
FIG. 2 is a partial cross-sectional view of the discharge vessel of the high pressure lamp in FIG. 1.
Figure 3:
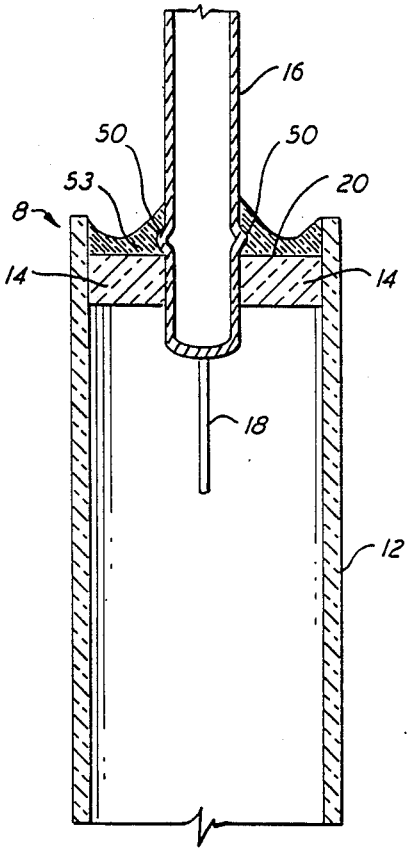
FIG. 3 is another partial cross-sectional view of one end of the discharge vessel of FIG. 2 with the electrode lead-through inserted therein in accordance with the invention.

Referring to FIGS. 2 and 3, discharge vessel 8 comprises elongated hollow ceramic cylinder 12 and closures 14 and 15 for mounting electrode lead-throughs 16 and 17 (FIG. 1), and electrode rods 18 and 19 (FIG. 1). The cylinder 12 has openings 26 and 27. Closure 14 is secured within opening 26 by a sintering process, and closure 15 is similarly secured within opening 27. Closure 14 has exterior surface 20 with aperture 40, and closure 21 similarly has exterior surface 21 with aperture 41. Apertures 40 and 41 have a predetermined diameter. Cylinder 12 and closures 14 and 15 may also be formed as a unitary ceramic structure. Electrode rod 18 (FIG. 3) is mounted on lead-through 16, and electrode rod 19 (FIG. 1) is similarly mounted on lead-through 17. Each electrode rod 18 and 19 is similarly disposed within cylinder 12.

Referring to FIGS. 4 and 5, lead-through 16 is crimped at a predetermined location on outer surface 28, forming four alternating expanded portions 30, 32, 34, and 36, and contracted portions 31, 33, 35, and 37. Expanded portions 30, 32, 34, and 36 comprise protuberances at their locations and make the diameter of the lead-through 16 greater than the predetermined diameter of apertures 40 or 41.

Protuberances 30, 32, 34 and 36 of lead-through 16 contacts exterior surface 20 of closure 14. This limits the extent of the insertion of lead-through 16 into discharge vessel 8, aligns lead-through 16 in closure 14 on a centerline attitude, and determines the distance electrode rod 18 is from closure 14. In the preferred embodiment the lead-through is symmetrically crimped at a predetermined location as illustrated in FIGS. 4 and 5.

Sealing frit 53 (FIG. 3) secures lead-through 16 within discharge vessel 8 in a gas-tight manner. Although not shown, lead-through 17 is similarly crimped and inserted into aperture 41 of closure 21 and sealed therein.

Those reasonably skilled in the art will appreciate that the lead-through can be crimped at a predetermined location to form a plurality of alternating contracted and expanded portions within the true spirit and scope of the invention.

Although the invention has been described with respect to a specific embodiment, it will be appreciated that modifications and changes may be made by those skilled in the art without departing from the true spirit and scope of the invention. For that reason the description is to be considered illustrative only and not restrictive.

What is claimed:

1. In a high pressure discharge lamp having a discharge vessel with a pair of end closures, each said closure having an aperture therethrough with a predetermined diameter, an electrode lead-through extending through said aperture, and an electrode mounted on said lead-through and inserted within said discharge vessel, said electrode lead-through comprising an elongated tubular member dimensioned to fit closely within said aperture through said closure, and a limiting means for limiting the distance said lead-through extends into said discharge vessel, wherein the improvement comprises:

said tubular lead-through being crimped at a predetermined location on its outer surface forming said limiting means including a plurality of alternating contracted and expanded portions, said contracted portions being free from contact from any interior element, said expanded portions comprise protuberances having a diameter greater than said predetermined diameter of said aperture for limiting the extent of insertion of said lead-through into said discharge vessel, for aligning the lead-through on said closure with a centerline attitude, and for determining the distance said electrode rod is inserted within said discharge vessel.

2. A high pressure discharge lamp according to claim 1, wherein said lead-through is symmetrically crimped at a predetermined location on its outer surface.

3. A high pressure discharge lamp according to claim 2, wherein said lead-through is symmetrically crimped at a predetermined location on its outer surface and said limiting means includes four alternating contracted and expanded portions, said expanded portions comprise protuberances.

4. In a high pressure discharge lamp having an elongate discharge vessel with a pair of end closures, each said end closure having a surface defining an aperture aligned with the longitudinal axis of said discharge vessel, each said end closure having an outer surface substantially transverse too the longitudinal axis of said discharge vessel, a pair of tubular electrode lead-throughs extending through said end closure, said lead-throughs having a rounded end portion defining a tip end of said lead-through and an opposite open end, said tip end being positioned within said discharge vessel and said opposing open end being exterior to said discharge vessel, said lead-throughs having a longitudinal axis and an outer surface, a pair of discharge electrodes each mounted on a said rounded end portion of a respective lead-through and aligned with the longitudinal axis of a said lead-through, said electrode being positioned within said discharge vessel so that an arc is maintained between said electrodes during lamp operation, wherein the improvement comprises:

a crimped portion of said tubular lead-throughs comprising four contracted and four expanded elongated portions equally spaced around the periphery of said lead-through and aligned with the longitudinal axis of said lead-through, said expanded portions having a substantially circular profile, each having a diameter which is larger than that diameter of said aperture, each said expanded portion having ends contacting said outer surface of said closure member equidistant from said tip end to limit the extent of insertion of said lead-through and said electrode into said discharge vessel, align said lead-through and said electrode with the longitudinal axis of said discharge vessel, and center said electrode in said closure member and said discharge vessel.

* * * * *